US008424155B2

(12) United States Patent
Hawkins et al.

(10) Patent No.: US 8,424,155 B2
(45) Date of Patent: Apr. 23, 2013

(54) UPRIGHT VACUUM CLEANER WITH AGITATOR LIFT FEATURE

(75) Inventors: Kyle A. Hawkins, Stanford, KY (US); Michael L. Fry, Danville, KY (US); Samuel A. Marsh, Ligonier, PA (US); Ryan T. Dant, Richmond, KY (US); Shannon D. Phegley, Danville, KY (US); Eric J. Streciwilk, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 0 days.

(21) Appl. No.: 13/337,763

(22) Filed: Dec. 27, 2011

(65) Prior Publication Data

US 2013/0055522 A1 Mar. 7, 2013

Related U.S. Application Data

(60) Provisional application No. 61/530,096, filed on Sep. 1, 2011.

(51) Int. Cl.
*A47L 9/06* (2006.01)
*A47L 5/34* (2006.01)

(52) U.S. Cl.
USPC ..... 15/368; 15/354; 15/333

(58) Field of Classification Search ..... 15/333, 15/354–359, 368
See application file for complete search history.

(56) References Cited

U.S. PATENT DOCUMENTS

| | | | | |
|---|---|---|---|---|
| 3,579,699 | A | 5/1971 | Balzer | |
| 4,446,594 | A | 5/1984 | Watanabe et al. | |
| 4,498,214 | A | 2/1985 | Oxel | |
| 4,782,552 | A | 11/1988 | Bartlett et al. | |
| 4,823,429 | A * | 4/1989 | Petralia | 15/333 |
| 4,823,430 | A | 4/1989 | Yonkers et al. | |
| 5,255,411 | A | 10/1993 | Da Costa | |
| 5,269,042 | A | 12/1993 | Stephens et al. | |
| 5,551,120 | A | 9/1996 | Cipolla et al. | |
| 5,906,024 | A | 5/1999 | Jailor et al. | |
| 5,974,625 | A | 11/1999 | Garner | |
| 6,081,963 | A | 7/2000 | Jailor et al. | |
| RE39,304 | E | 9/2006 | Kasen et al. | |
| 7,653,964 | B2 * | 2/2010 | Kwon et al. | 15/354 |
| 7,861,369 | B2 * | 1/2011 | Miner et al. | 15/390 |
| 7,941,896 | B2 | 5/2011 | Park et al. | |
| 2010/0192324 | A1 * | 8/2010 | Maguire et al. | 15/415.1 |
| 2011/0035899 | A1 * | 2/2011 | Charlton et al. | 15/347 |

* cited by examiner

*Primary Examiner* — Dung Van Nguyen
(74) *Attorney, Agent, or Firm* — King & Schickli, PLLC

(57) ABSTRACT

A floor cleaning apparatus includes a body having a nozzle assembly and a canister assembly. The handle assembly is pivotally attached to the nozzle assembly. The nozzle assembly includes an agitator cavity that receives a rotary agitator. Both a suction generator and a dirt collection vessel are carried on the body. In addition, the vacuum cleaner includes an agitator lift assembly. The agitator lift assembly includes a sliding actuator and a fulcrum plate.

12 Claims, 6 Drawing Sheets

UPRIGHT VACUUM CLEANER WITH AGITATOR LIFT FEATURE

This application claims the benefit of U.S. Provisional Patent Application Ser. No. 61/530,096, filed 1 Sep. 2011, the entire disclosure of which is incorporated herein by reference.

TECHNICAL FIELD

The present invention relates generally to the floor care equipment field and, more particularly, to an upright vacuum cleaner with a simple and effective agitator lift feature.

BACKGROUND OF THE INVENTION

Upright vacuum cleaners are well known in the art. Upright vacuum cleaners generally include a nozzle assembly equipped with wheels that allows the nozzle assembly to be rolled across the floor being cleaned. The nozzle assembly includes a suction inlet and more often than not is incorporated with a rotary agitator that sweeps dirt and debris from the nap of an underlying carpet being cleaned.

A handle assembly is pivotally connected to the nozzle assembly. Typically, a dirt collection vessel in the form of a vacuum cleaner bag or a dirt cup is carried on the nozzle assembly. A suction generator is also provided to produce a negative air stream that draws dirt and debris into the vacuum cleaner. The dirt and debris is captured in the dirt collection vessel and clean air is exhausted back into the environment. The suction generator may be carried either on the handle assembly or the nozzle assembly.

During floor cleaning operation, the handle assembly is tilted with respect to the nozzle assembly at oblique angles. Thus, the handle assembly is inclined to allow the operator to guide the vacuum cleaner to and fro across the floor. Periodically the operator may need to release the handle in order to move a piece of small furniture or other object to allow cleaning. At this time the operator typically pushes the handle forward into the upright or storage position. If the rotary agitator of the vacuum cleaner remains activated, the projecting bristle tufts of a rotary agitator will continually engage an underlying carpet at a single point potentially creating unnecessary carpet wear. In order to address this problem some upright vacuum cleaners have been equipped with an agitator lift feature whereby the nozzle assembly and the rotary agitator connected thereto are lifted away from the floor so that the bristle tufts do not engage and create carpet wear while the vacuum cleaner remains stationary with the handle in the upright storage position. Examples of prior art agitator lift features may be found in, for example, U.S. Pat. Nos. 3,579,699; 5,269,042; 5,551,120; and 5,974,625.

This document describes a new and improved agitator lift feature for an upright vacuum cleaner that is of simple and inexpensive construction and that provides very efficient and effective operation.

SUMMARY

A floor cleaning apparatus comprises a body including a nozzle assembly and a handle assembly. The handle assembly is pivotally attached to the nozzle assembly. The nozzle assembly includes an agitator cavity holding a rotary agitator. Both a suction generator and a dirt collection vessel are carried on the body. Further, the floor cleaning apparatus includes an agitator lift assembly.

The agitator lift assembly includes a sliding actuator carried on the nozzle assembly and a fulcrum plate pivotally attached to the nozzle assembly. The fulcrum plate includes (a) a first edge, (b) a second, opposite edge, (c) a pivot projecting beyond the first edge and (d) a lug projecting from the second edge. The sliding actuator has a first end and a second end. The second end of the sliding actuator engages the lug.

The floor cleaning apparatus also includes a height adjustment roller that is carried on the fulcrum plate. The height adjustment roller is carried on the fulcrum plate adjacent the second edge. The pivot engages the nozzle assembly adjacent the agitator cavity. In one particularly useful embodiment the pivot comprises a series of aligned gudgeons and the nozzle assembly includes a bottom plate having a recess. The fulcrum plate nests in the recess when the agitator is in a lowered operating position.

In accordance with still further aspects, the handle assembly includes a surface that engages the first end of the sliding actuator so that when the handle assembly is in an upright rest position the agitator is raised. Further, the handle assembly includes a pivot bracket that pivotally mounts the handle assembly to the nozzle assembly. The pivot bracket includes a shoulder that engages the first end of the sliding actuator so that when the handle assembly is in the upright, rest position, the agitator is raised.

In the following description there is shown and described a vacuum cleaner with an agitator lift feature, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the vacuum cleaner and agitator lift feature. In the drawings.

Reference will now be made in detail to the present preferred embodiment of the vacuum cleaner, examples of which are illustrated in the accompanying drawings.

DETAILED DESCRIPTION OF THE PREFERRED EMBODIMENTS

Figure 1:
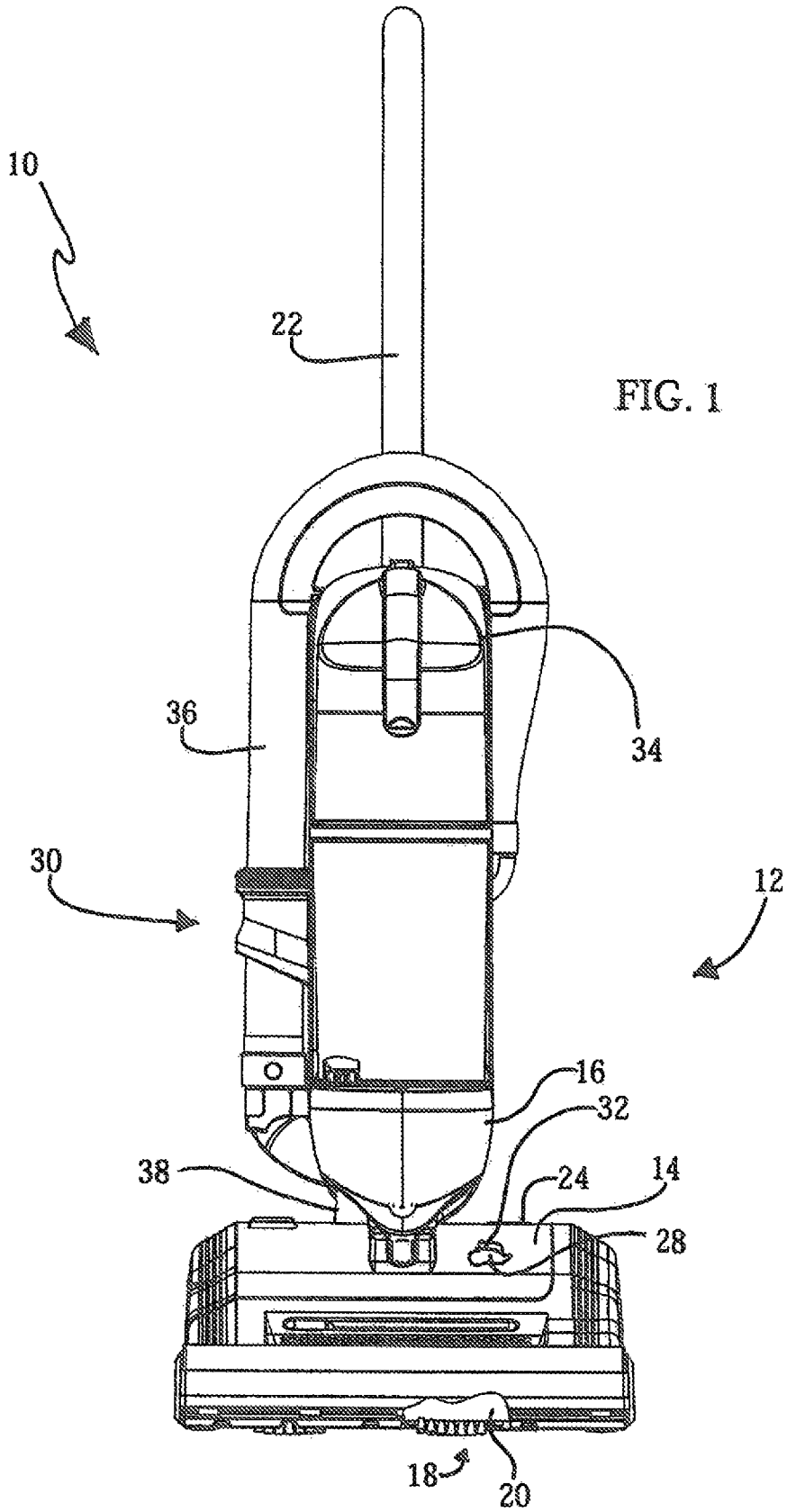
FIG. 1 is a front elevational and partially broken away view of a vacuum cleaner.
Figure 2:
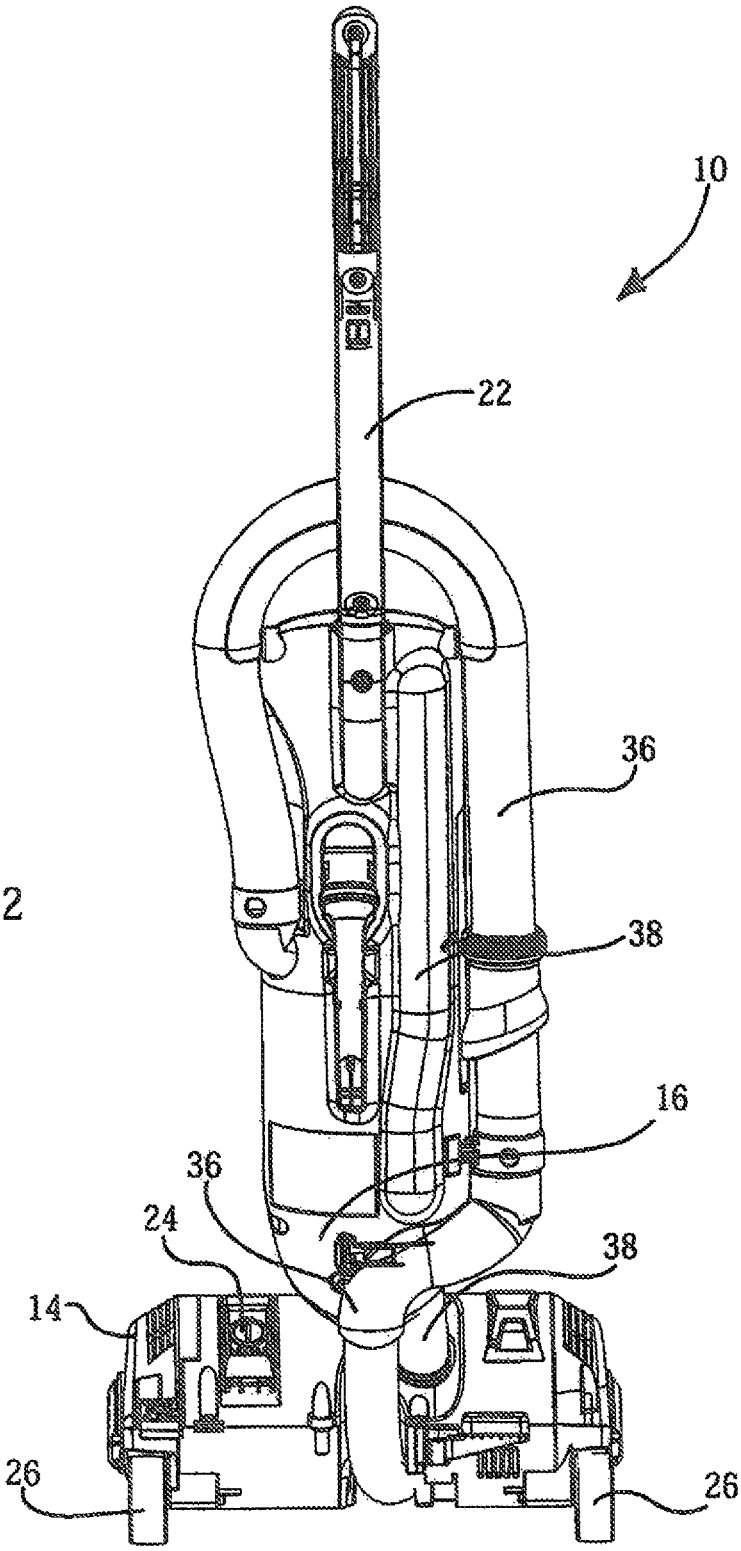
FIG. 2 is a rear elevational view of the vacuum cleaner illustrated in FIG. 1.

Reference is now made to FIGS. 1 and 2 illustrating the floor care apparatus of the present invention in the form of an upright vacuum cleaner 10. The upright vacuum cleaner 10 has a body 12 comprising a nozzle assembly 14 and a handle assembly 16. As is known in the art, the nozzle assembly 14 and handle assembly 16 are pivotally connected together. Further, the nozzle assembly 14 includes an agitator cavity or a suction inlet 18. A rotary agitator 20 is mounted on the nozzle assembly 14 in the agitator cavity 18. The rotary agitator 20 may be equipped with bristles, tufts, wipers or other projecting cleaning structures 21 in a manner known in the art.

The handle assembly 16 includes a control stalk 22 by which the operator may control the movement of the vacuum cleaner 10 during the cleaning operation. A control switch 24 allows the operator to turn the vacuum cleaner on and off. Wheels 26 provided on the body 12 allow the vacuum cleaner 10 to be moved smoothly across the floor. Both a suction generator 28, such as a fan and motor assembly, and a dirt collection assembly or vessel 30 are carried on the body 12. In the illustrated embodiment the nozzle assembly 14 includes an internal compartment 32 for receiving the suction generator 28 and the handle assembly 16 includes an opening 34 for receiving and holding the dirt collection assembly 30. Conduits 36, including flexible hoses, connect the suction inlet 18 with the dirt collection assembly 30. Conduits 38, including flexible hoses, connect the dirt collection assembly 30 with the suction generator 28.

During vacuum cleaner operation, the operator manipulates the vacuum cleaner using the control stalk 22. Specifically, the operator pivots the handle assembly 16 relative to the nozzle assembly 14 so that the control stalk 22 moves from the storage position illustrated in FIGS. 1, 2 and 4*a* to an oblique, operating position illustrated in FIG. 4*b*. The operator is then able to move the vacuum cleaner 10 smoothly across the floor being cleaned as the handle assembly 16 freely pivots relative to the nozzle assembly 14.

Reference is now made to FIGS. 3, 4*a*, 4*b* and 5 illustrating aspects of the agitator lift assembly 50 provided on the vacuum cleaner 10. As illustrated, the agitator life assembly 50 includes a sliding actuator 52 secured to the housing 54 of the nozzle assembly 14 by means of the mounting bracket 56. In addition, the agitator lift assembly 50 includes a fulcrum plate 58. Fulcrum plate 58 includes a first or front edge 60 and a second or rear edge 62. A pivot, in the form of a series of aligned gudgeons 64 project beyond the first edge 60 of the fulcrum plate 58. A lug 66 projects from the fulcrum plate 58 beyond the second edge 62.

One or more height adjustment rollers 68 are provided in a cooperating roller cavity 70 on the fulcrum plate 58 parallel and adjacent to the second edge 62. The rollers 68 freely rotate on the stub shafts 72 with respect to the fulcrum plate 58. The gudgeons 64 that pivotally connect the fulcrum plate 58 to the bottom plate 74 of the nozzle assembly 14 are received in cooperating sockets 76 adjacent to the agitator cavity 18 (see particularly FIG. 5). The sliding actuator 52 includes a first end 78 and a second end 80. As should be appreciated, the second end 80 engages the distal end of the lug 66 projecting from the fulcrum plate 58.

Figure 3:
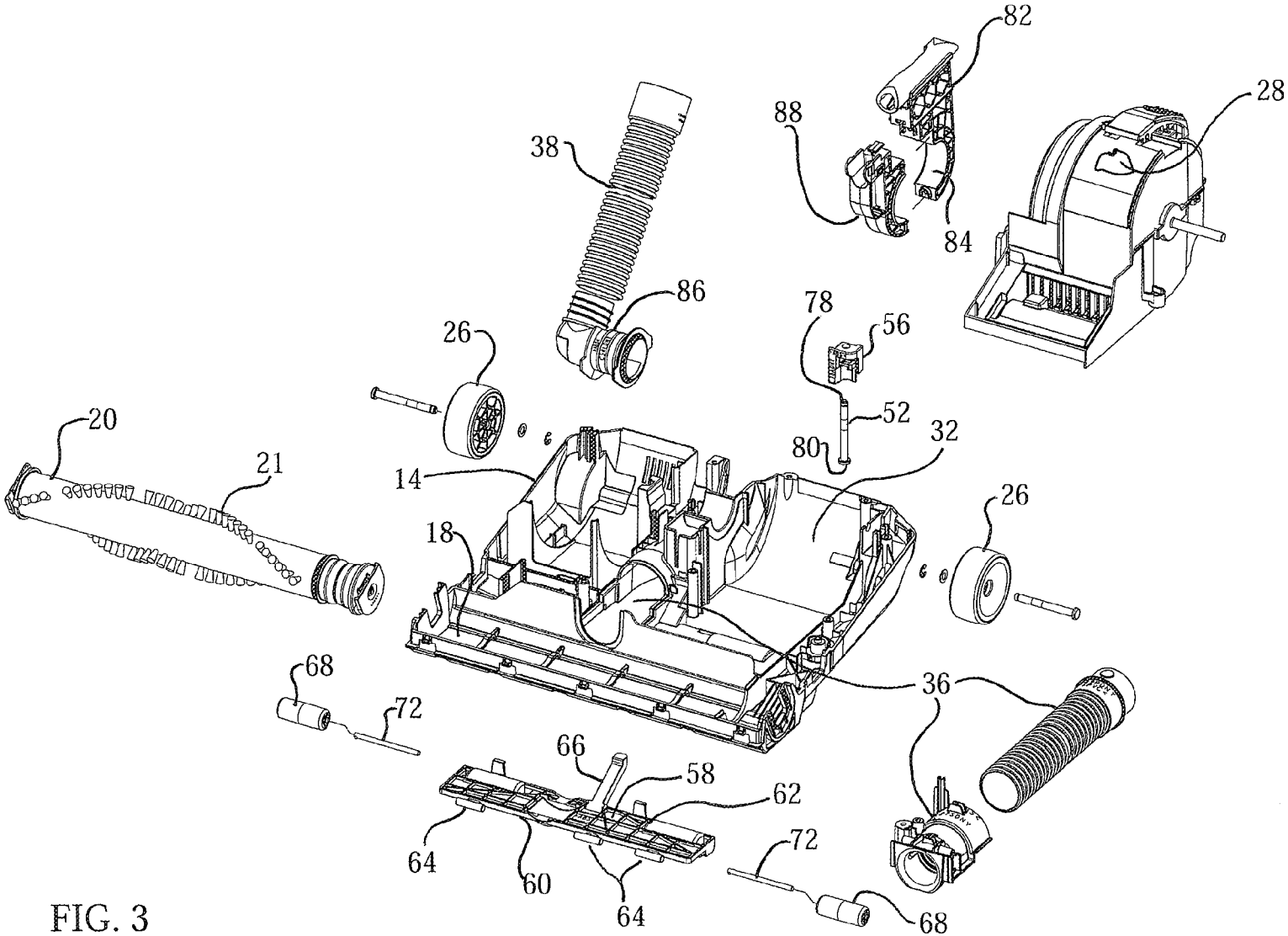
FIG. 3 is an exploded perspective view of the nozzle assembly of the vacuum cleaner.
Figure 4A:
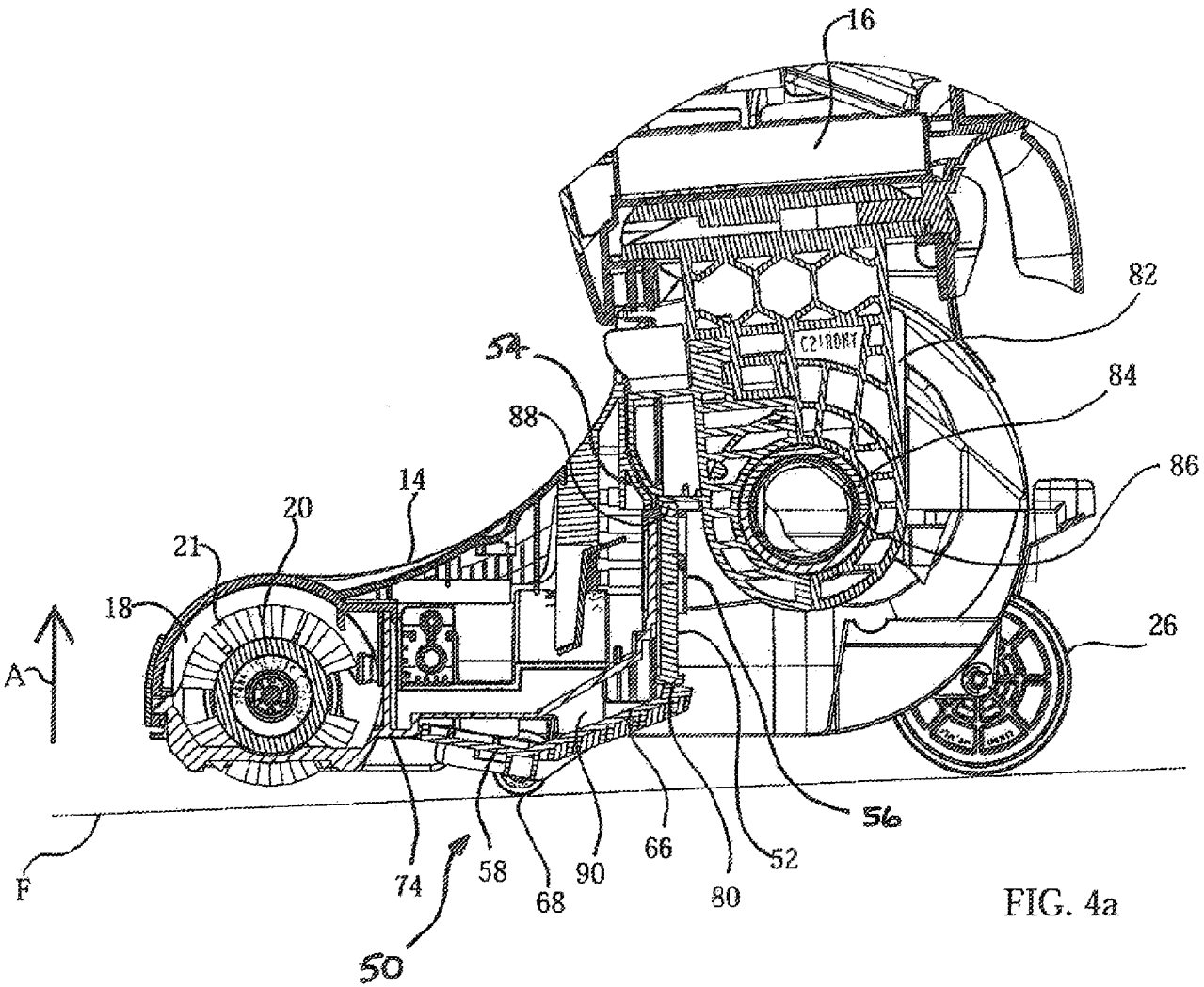
FIGS. 4*a*-4*b* are respective cross sectional views illustrating the nozzle assembly in the agitator raised or rest position and in the agitator lowered or operating position.
Figure 4B:
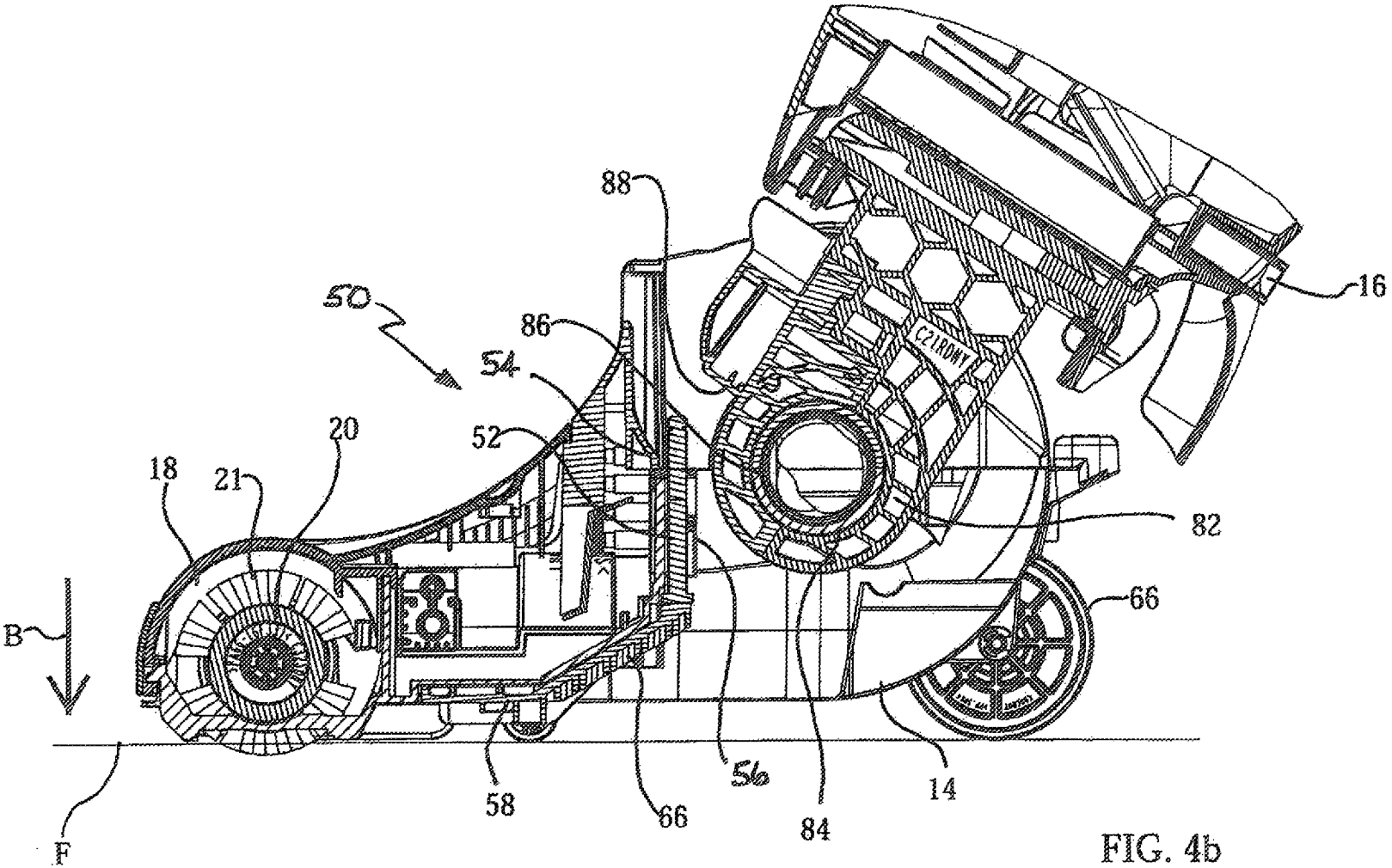
Figure 5:
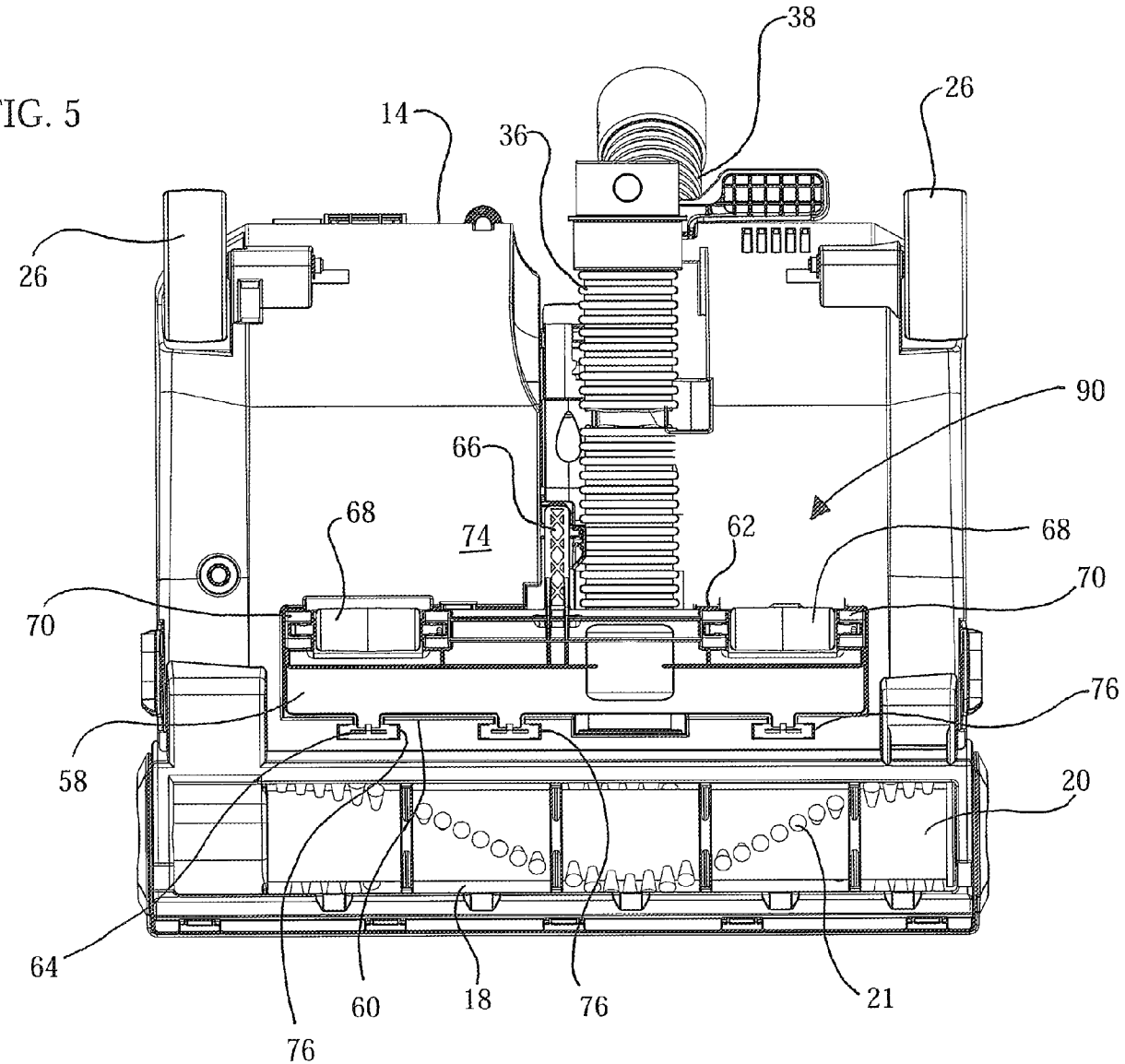
FIG. 5 is a detailed bottom plan view showing the pivotal connection of the fulcrum plate to the bottom plate of the agitator housing.

As best illustrated in FIGS. 3, 4*a* and 4*b*, the handle assembly 16 is pivotally connected to the nozzle assembly 14 by means of a pivot bracket 82. The pivot bracket 82 includes a hub 84 that is received around the air stream conduit 86 that is fixed to the nozzle assembly 14. In this way the pivot bracket 82 of the handle assembly 16 provides for free pivoting motion of the handle assembly 16 with respect to the nozzle assembly 14 about the transverse axis A.

As the handle assembly 16 is pushed forward into the upright rest or storage position illustrated in FIGS. 1, 2 and 4*a*, a shoulder 88 on the pivot bracket 82 engages the first end 78 of the sliding actuator 52. This movement forces the sliding actuator 52 to slide downwardly in the mounting bracket 56 with respect to the nozzle assembly 14. Since the second end 80 of the sliding actuator 52 engages the lug 66, this movement also causes the fulcrum plate 58 to pivot on the gudgeons 64 away from the bottom plate 74 of the nozzle assembly. As a result, the rotary agitator 20 is lifted upwardly from the floor F (see particularly action arrow A in FIG. 4*a*). In this position the rotary agitator 20 may rotate without engaging an underlying carpet. This prevents any potential for excessive carpet wear that might otherwise be produced by the cleaning structures 21 of the rotary agitator 20 if the vacuum cleaner 10 is left while running for an extended period of time in one place.

In contrast, when the handle assembly 16 is pivoted into an oblique operating position as illustrated in FIG. 4*b*, the shoulder 88 moves away from the first end 78 of the sliding actuator 52 and the weight of the nozzle assembly 12 forces the fulcrum plate 58 to pivot about the gudgeons 64 until the fulcrum plate is flush against the bottom plate 74 and fully received in the recess 90 into which the fulcrum plate nests. As this occurs the rotary agitator 20 is effectively lowered toward the floor (note action arrow B) where it can engage the nap of an underlying carpet. In this position the bristle tufts 21 of the rotary agitator 20 effectively beat or sweep dirt and debris from the nap of the underlying carpet as the rotary agitator rotates within the suction inlet 18 of the nozzle assembly 12.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor cleaning apparatus, comprising:

a body including a nozzle assembly and a handle assembly, said handle assembly being pivotally attached to said nozzle assembly and said nozzle assembly including an agitator cavity holding a rotary agitator;

a suction generator carried on said body;

a dirt collection vessel carried on said body; and an agitator lift assembly, said agitator lift assembly including (a) a sliding actuator carried on said nozzle assembly and (b) a fulcrum plate pivotally attached to said nozzle assembly, said fulcrum plate including a first edge and a second, opposite edge, a pivot projecting beyond said first edge and a lug projecting from said second edge.

2. The apparatus of claim 1, wherein said sliding actuator has a first end and a second end.

3. The apparatus of claim 2, wherein said second end of said sliding actuator engages said lug.

4. The apparatus of claim 3, further including a height adjustment roller carried on said fulcrum plate.

5. The apparatus of claim 4, wherein said height adjustment roller is carried on said fulcrum plate adjacent said second edge.

6. The apparatus of claim 5, wherein said pivot engages said nozzle assembly adjacent said agitator cavity.

7. The apparatus of claim 6, wherein said pivot comprises a series of aligned gudgeons.

8. The apparatus of claim 7, wherein said nozzle assembly includes a bottom plate having a recess and said fulcrum plate nests in said recess when said agitator is in a lowered, operating position.

9. The apparatus of claim 6, further including a mount securing said sliding actuator to said nozzle assembly.

10. The apparatus of claim 6, wherein said handle assembly includes a surface that engages said first end of said sliding actuator so that when said handle assembly is in an upright rest position, said agitator is raised.

11. The apparatus of claim 6, wherein said handle assembly further includes a pivot bracket that pivotally mounts said handle assembly to said nozzle assembly.

12. The apparatus of claim 6, wherein said pivot bracket includes a shoulder that engages said first end of said sliding actuator so that when said handle assembly is in an upright, rest position, said agitator is raised.

* * * * *